US011765504B2

(12) United States Patent
Christoph

(10) Patent No.: US 11,765,504 B2
(45) Date of Patent: Sep. 19, 2023

(54) INPUT SIGNAL DECORRELATION

(71) Applicant: Harman Becker Automotive Systems GmbH, Karlsbad (DE)

(72) Inventor: Markus Christoph, Straubing (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 272 days.

(21) Appl. No.: 17/002,674

(22) Filed: Aug. 25, 2020

(65) Prior Publication Data

US 2021/0076133 A1 Mar. 11, 2021

(30) Foreign Application Priority Data

Sep. 10, 2019 (DE) ..... 102019124285.1

(51) Int. Cl.
*H04R 3/04* (2006.01)
*G10L 25/51* (2013.01)

(52) U.S. Cl.
CPC ..... *H04R 3/04* (2013.01); *G10L 25/51* (2013.01)

(58) Field of Classification Search
None
See application file for complete search history.

(56) References Cited

U.S. PATENT DOCUMENTS 9,412,354 B1 * 8/2016 Ramprashad ..... H04R 3/005
2008/0137874 A1 6/2008 Christoph
2008/0247558 A1 * 10/2008 Laroche ..... G10L 21/00 381/66
2014/0185811 A1 * 7/2014 Stein ..... H04S 7/307 381/98
2017/0070839 A1 * 3/2017 Mihelich ..... H04R 5/02

FOREIGN PATENT DOCUMENTS

EP 2466864 B1 * 2/2019 ..... H04M 9/082

OTHER PUBLICATIONS

Laura Romoli et al., "A Mixed Decorrelation Approach for Stereo Acoustic Echo Cancellation Based on the Estimation of the Fundamental Frequency", Feb. 2012, IEEE, vol. 20, pp. 690-697. (Year: 2012).*
Buchner et al., English Translation of EP2466864B, Feb. 27, 2019, EPO, entire document (Year: 2019).*

* cited by examiner

*Primary Examiner* — Antim G Shah
(74) *Attorney, Agent, or Firm* — McCoy Russell LLP

(57) ABSTRACT

Decorrelating an input signal includes allpass filtering to phase shift the first input signal by a phase shift, the allpass filtering comprising filtering with one or more subsequent controllable allpass filter stages, each controllable allpass filter stage having a filter quality and a cut-off frequency. Decorrelating further includes controlling at least one of the filter quality and the cut-off frequency of the controllable allpass filter stages to change over time.

17 Claims, 3 Drawing Sheets

INPUT SIGNAL DECORRELATION

CROSS REFERENCE TO RELATED APPLICATIONS

The present application claims priority to German Patent Application No. 102019124285.1, entitled "INPUT SIGNAL DECORRELATION", and filed on Sep. 10, 2019. The entire contents of the above-listed application are hereby incorporated by reference for all purposes.

TECHNICAL FIELD

The disclosure relates to a system and method (generally referred to as a "system") for decorrelating an input signal.

BACKGROUND

In some cases, for example in multichannel adaptive systems, it may be beneficial for reference or input signals used to be statistically independent of each other, i.e. to have a high a degree of decorrelation. For example, changes in a room may be automatically recognized and compensated for based on continuously estimated room impulse responses (RIR) of a multi-channel adaptive system for suppressing acoustic echoes (AEC). When doing so, the RIRs represented by room transfer functions between loudspeakers and microphones installed in the room are determined (e.g., calculated, estimated etc.) and compared to stored reference data previously determined in a reference room. The resulting spectral deviation then forms the basis for determining the compensation filter, which may makes it possible to create a sound impression that is subjectively consistent, independent of the currently existing acoustic conditions in the room. As long as the multi-channel adaptive system uses mono-signals, e.g. emits sound omnidirectionally, determining or using the adaptively estimated RIRs will be straightforward. However, if the device is operated in stereo or, in general, in a multichannel playback modus—in which, for example, numerous different signals that might be spatially vectored are played back—ambiguities may arise among the adaptively determined RIRs, depending on the degree of correlation between the signals used. In this case it may be more difficult to use the method for automatically compensating for room changes, as discussed above, which, as is known, relies on continuously determined RIRs.

Such ambiguities in the estimation of the RIRs may be addressed by ensuring that the various input signals to be played back are sufficiently decorrelated from each other. In general, both channels of a stereo system are sufficiently decorrelated from each other and thus, in the case of a pure stereo playback, this problem may not arise. It does indeed arise, however, when so-called "upmixing" algorithms, such as, for example, Logic7 or Dolby Pro Logic are used. These generate a multichannel signal (e.g. a 5.1 signal from a stereo input signal), wherein the generated additional signals may no longer possess a high degree of decorrelation from each other, which may increase a probability of ambiguity in the estimation of the RIRs. For this reason, employing a decorrelator may be beneficial. Therefore it is generally desirable to explore systems and methods for reliably decorrelating multi-channel audio signals.

SUMMARY

An example decorrelator for decorrelating an input signal includes a controllable allpass filter arrangement configured to phase shift the first input signal by a phase shift, the allpass filter arrangement comprising one or more controllable allpass filter stages connected in series, and each controllable allpass filter stage having a filter quality and a cut-off frequency. The decorrelator further includes a filter controller operatively connected to the controllable allpass filter arrangement and configured to control at least one of the filter quality and the cut-off frequency of the controllable allpass filter stages to change over time.

An example decorrelation method for decorrelating an input signal includes allpass filtering to phase shift the first input signal by a phase shift, the allpass filtering comprising filtering with one or more subsequent controllable allpass filter stages, each controllable allpass filter stage having a filter quality and a cut-off frequency. The method further includes controlling at least one of the filter quality and the cut-off frequency of the controllable allpass filter stages to change over time.

Other systems, methods, features and advantages will be, or will become, apparent to one with skill in the art upon examination of the following detailed description and appended figures (FIGs.). It is intended that all such additional systems, methods, features and advantages be included within this description, be within the scope of the invention, and be protected by the following claims.

BRIEF DESCRIPTION OF THE DRAWINGS

The system and method may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
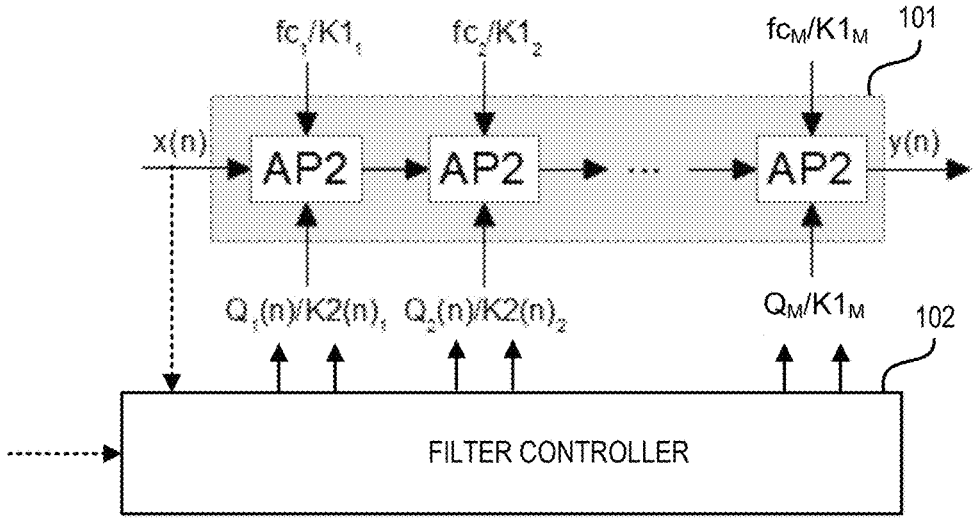
FIG. 1 is a schematic diagram illustrating an example time-variable decorrelator in which filter cutoff frequencies are time-invariable and filter quality factors are time-variable.

FIG. 1 illustrates an exemplary time-variable decorrelator in which filter cutoff frequencies $fc_m$,(n) are time-invariable and filter quality factors $Q_n$ (n) are time-variable, wherein n is a discrete time parameter, m=[1, . . . , M] and M=the (integer) number of allpass filter stages included in the decorrelator. For example, M $2^{nd}$ order allpass filter stages AP2 may be connected in series constituting a chain 101 of allpass filter stages AP2, wherein a filter controller 102 controls filter quality factor $Q_n$ (n) of each allpass filter stage AP2 to vary over time. Alternatively, the quality factors $Q_m$(n) are time-invariable and the cutoff frequencies $fc_m$(n) are time-variable. In this case, the poles, the spectral location of which in the unit circle is determined exclusively by the base frequency of the filter, may thus, for example, be distributed nonlinearly throughout the frequency similar to that of the human ear, which makes sense from a psychoacoustic perspective. The decorrelator receives an input signal x(n) to be decorrelated, and provides a decorrelated signal y(n).

Additionally or alternatively, in one embodiment, filter base frequencies with a maximum frequency of fs/4 may be chosen in order to ensure that the resulting group delay of the allpass filter chain does not only rise to only this frequency due to the accumulation of the individual, constantly falling phase response, but that it also begins to fall again after having reached the maximum frequency of fs/4, thus avoiding an excessive and unwanted build-up of the group delay. Regardless of this, the options mentioned above, as well as an option in which both filter parameters, i.e. the cutoff frequencies $fc_n(n)$ and the quality factors $Q_n(n)$ are time-variable, may be used.

Figure 2:
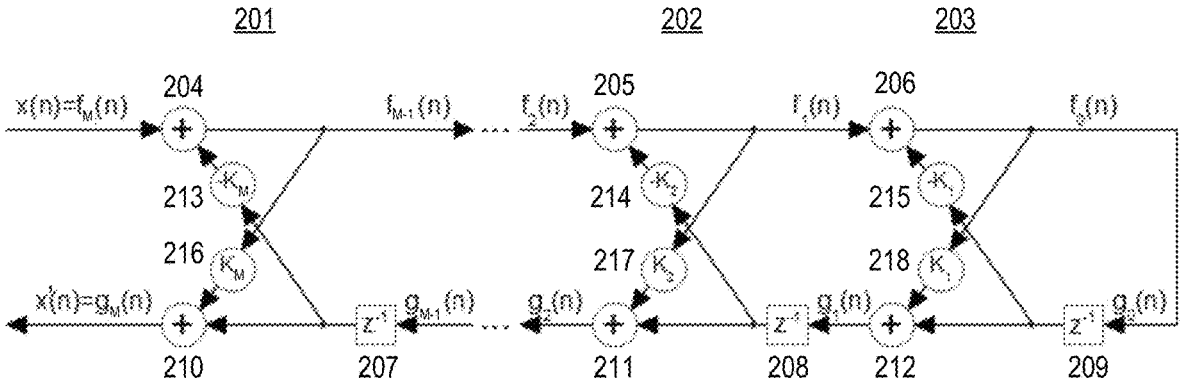
FIG. 2 is a schematic diagram illustrating a two-multipliers design of an allpass filter of M-th order.

A simple way of implementing parametric allpass filter stages of M-th order is, for example, provided by lattice ladder filters, of which various designs exist such as, for example, the one-multiplier, two-multipliers and four-multipliers designs. In allpass filters, the attenuation of the filter is constant at all frequencies but the relative phase between input and output varies with frequency. FIG. 2 illustrates an example signal flow of the 2 fold multiplying design of an allpass filter of M-th order. As can be seen from FIG. 2, an example allpass filter stage with lattice ladder design includes multiple lattice stages 201, 202 and 203, each of which has the same basic structure. Each single stage 201, 202, 203 has a forward path input, forward path output, backward path input and backward path output. The forward path input is operatively coupled with one input of a forward adder 204, 205, 206, the output of which serves as the forward path output. The backward path input is operatively coupled via a time delay 207, 208, 209 with one input of a backward adder 210, 211, 212, the output of which serves as the backward path output. Another input of the forward adder 204, 205, 206 is operatively coupled via a first multiplier 213, 214, 215 and the time delay 207, 208, 209 with the backward path input. Another input of the backward adder 210, 211, 212 is operatively coupled via a second multiplier 216, 217, 218 with the forward path output.

The forward path input of stage 201 receives a filter input signal $x(n)=f_M(n)$ and provides a filter output signal $x'(n)=g_M(n)$ at its backward path output. Further, the backward path input of stage 201 receives a signal $g_{M-1}(n)$ and provides a signal $f_{M-1}(n)$ at its forward path output. For example, if n=3, the signal $g_{M-1}(n)$ is $g_2(n)$ and the signal $f_{N-1}(n)$ is $f_2(n)$. In the example shown in FIG. 2, the signal $g_2(n)$ is provided at the backward path output of lattice stage 202 and the signal $f_2(n)$ is received at the forward path input of lattice stage 202. Further, lattice stage 201 provides at its forward path output a signal $f_2(n)$, which is sent to the forward path input of lattice stage 203, and receives at its backward path input a signal $g_1(n)$ from the backward path output of lattice stage 203. The forward path output of lattice stage 203 provides a signal $f_0(n)$ which serves as a signal $g_0(n)$ supplied to the backward path input of lattice stage 203.

An advantage of lattice ladder filters is that their filter coefficients correspond to the reflection coefficients which, for example, may be determined using the Levinson Durbin Recursion. One of the properties of the reflection coefficients is that they make sure that the filter is stable as long as their value stays smaller than 1, i.e. as long as $K_m \leq |1|$, wherein m=1, . . . , M, and M is the order of the filter.

In the case of a $2^{nd}$ order lattice ladder allpass filter, the first filter (or reflection) coefficient $K_1$ corresponds to the filter cutoff frequency fc and the second filter coefficient $K_2$ corresponds to the filter quality factor Q. With this, filter coefficients $K_c$ can be easily generated over time, e.g. by way of an ordinary pseudo random number generator (white noise generator) which provides quasi-random values from the range of [−1, . . . , +1]. The range of values used can be further limited, e.g. in order to prevent the filter quality factor from becoming too large, according to:

$K2(n)_{1, \ldots M} \in [0, \ldots, K2_{Max}]$, with $K2_{Max} \leq 1$ and M is the number of allpass filters in the chain.

In order to prevent the generation of disturbing acoustic artefacts, the dynamics over time of the time-variable filter parameter(s) or filter coefficient(s) is limited, i.e. the time-variable filter parameter(s) or filter coefficient(s) change not too greatly. To achieve this, either the dynamics range within which the filter parameter(s) in question (fc and/or Q) may change from one sample to the next is accordingly limited (for example: fc may not change from one sample to the next by more than Δfc=1 [Hz]), or the time duration over which the filter parameter(s) may unlimitedly change is very long, in which case interpolations may be performed in between.

Here the advantage of employing lattice ladder filters for implementing the allpass filters and the accompanying reflection filter coefficients once again becomes apparent as using such a structure allows the parameter changes to be carried out directly in the filter coefficients. As opposed to this, when common allpass filters are used, e.g. in a direct form structure, the filter coefficients must be constantly calculated anew from the limited or interpolated filter parameters, which entails a considerable computational effort that is not needed with lattice ladder filters.

In practice, an update time of approximately $t_{ud}$=1 [s] may be useful, for example, every $t_{ud}$, new time-variable filter coefficients $K2_c$, wherein c=1, . . . , C, and C is the number of $2^{nd}$ order allpass filters, are calculated by way of a pseudo random number generator from a range of $K2_c \in [0, \ldots, K2_{max}]$, and are applied. Within the time period determined by $t_{ud}$ these are then (e.g. linearly) interpolated, so that, by the end of $t_{ud}$ all time-variable filter coefficients $K2_c(n)$ correspond to the new values generated by the pseudo random number generator. In this simple manner and without an undue increase of the computational effort, disturbing acoustic artefacts can be so greatly reduced that they no longer present an acoustic problem.

Figure 3:
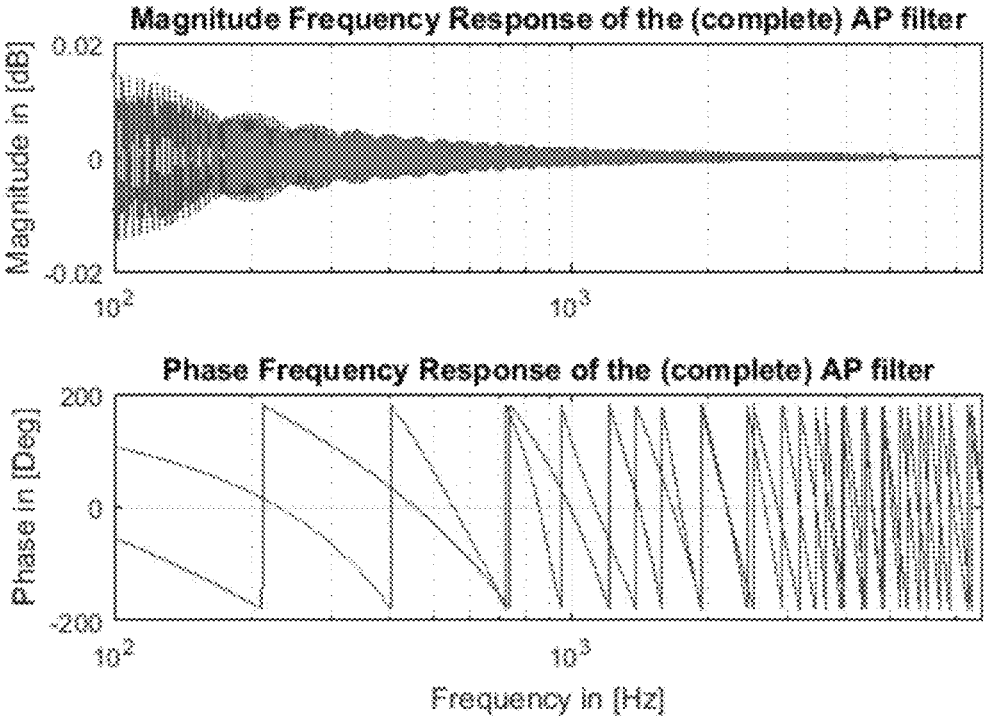
FIG. 3 is a Bode diagram illustrating magnitude and phase curves of two exemplary allpass filter chains.

FIG. 3 is a Bode diagram illustrating magnitude curves (upper curves in FIG. 3) and phase curves (lower curves n FIG. 3) of two exemplary allpass filter chains operated at a sampling rate $f_s$ of 16 [kHz] and each chain including 16 allpass filter stages of 2nd order. The filter cutoff frequency is limited to a band between 100 [Hz] and $f_s/2-f_s/8$ [Hz] and may be linearly or according to a psychoacoustic scale (e.g. the Bark scale) distributed within this range. The maximum admissible quality factor is determined by $K2_{max}$=0.99 and the time-variable filter parameter $K2_c(n) \in [0, \ldots, K2_{max}]$. Interpolation of the time-variable filter parameter is performed linearly and the signals to be decorrelated are the left and right channel signals of a multichannel signal, wherein the center channel signal is not processed. The left channel signal is fed to one allpass filter chain and the right channel to the other. From the upper curves of FIG. 3 it can be seen that level deteriorations caused by the allpass filter chains are negligible.

Figure 4:
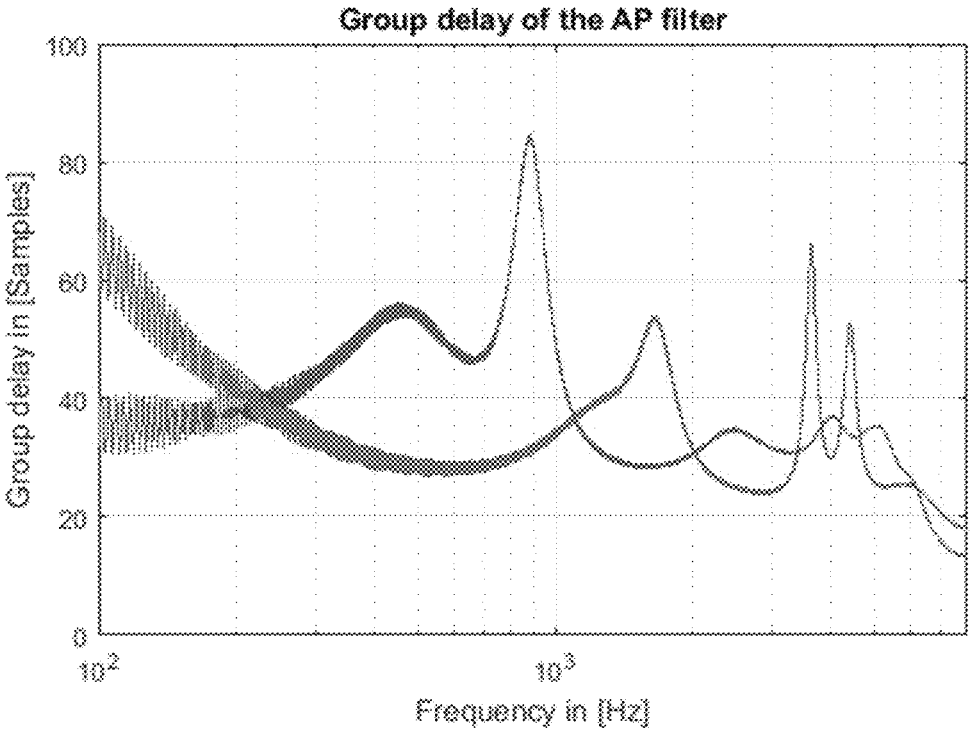
FIG. 4 is a diagram illustrating the group delay over frequency of each chain.

FIG. 4 is a diagram depicting the group delay [samples] over frequency [Hz], which illustrates that the group delay of each chain, dependent on the above-bounded filter cutoff frequencies, does not increase at higher frequencies, but instead decreases towards the Nyquist frequency $f_s/2$.

Figure 5:
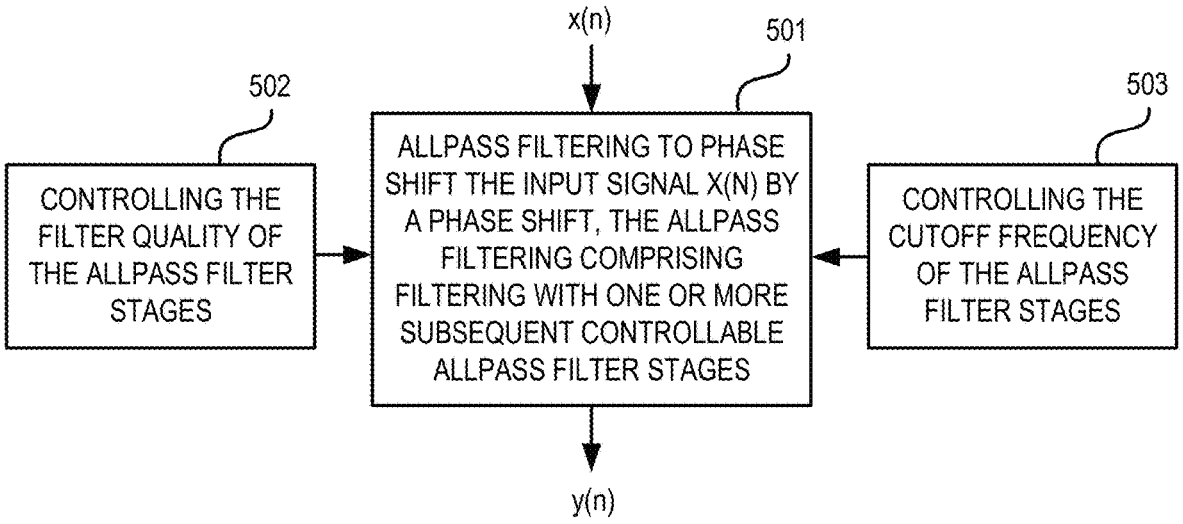
FIG. 5 is a flow chart illustrating an example method for decorrelating an input signal.

Referring to FIG. 5, an exemplary decorrelation method for decorrelating an input signal includes allpass filtering to phase shift the first input signal x(n) by a phase shift, the allpass filtering comprising filtering with one or more subsequent controllable allpass filter stages, each controllable allpass filter stage having a filter quality and a cut-off frequency (procedure 501). The method further includes controlling at least one of the filter quality (procedure 502) and the cut-off frequency (procedure 503) of the controllable allpass filter stages to change over time.

Figure 6:
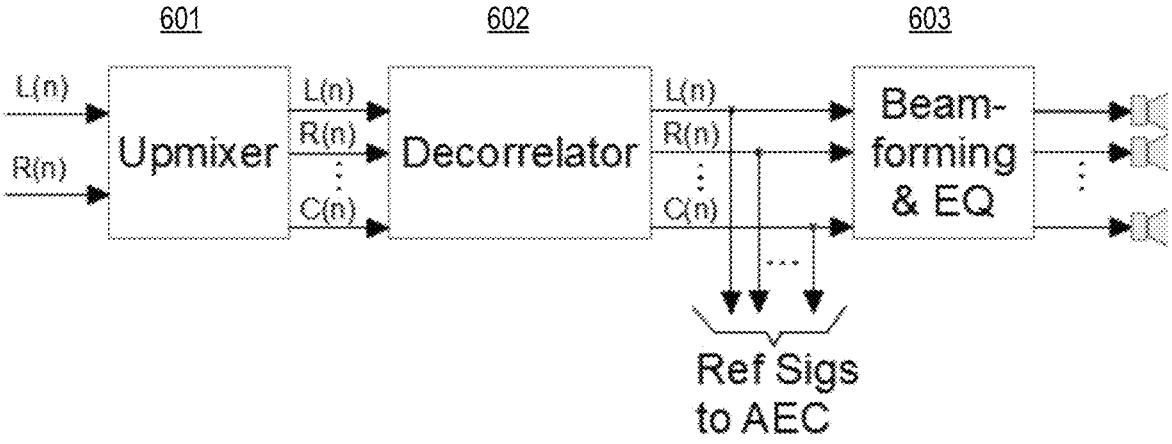
FIG. 6 is a signal flow diagram of an exemplary application of a decorrelator.

FIG. 6 is a signal flow diagram of an exemplary application of a decorrelator. As illustrated in FIG. 6, an upmixer 601 that may make use of an upmixing algorithm, extracts a center signal C(n) from two stereo input signals L(n) and R(n). Then, these three signals are decorrelated in a decorrelator 602 and directed in various directions in the room using corresponding beamforming filters of a beamformer 603, wherein the extracted center signal C(n) is directed to the listening position and the two stereo signals L(n) and R(n) are emitted in the opposite direction, i.e. backwards where, ideally, solid walls are located, thus creating a specific acoustic effect from the resulting diffusion. In one option, the extracted center signal C(n) is decorrelated since the two stereo signals L(n) and R(n) may already sufficiently be uncorrelated with respect to each other, and may, thus, be taken as they are for beamforming. Alternatively, not the direct sound is decorrelated, that is the center channel, generated from the two stereo signals, but rather the two effect channels, that is the two stereo signals L(n) and R(n), as decorrelation may further increase the diffusion of these signals.

In a further example, the allpass filter parameters, cut-off frequencies and/or quality factors, are controlled dependent on a correlation analysis of the input signal and at least one comparison signal (e.g., the other input or reference signals) so that decorrelation is only applied (e.g. in certain spectral ranges) if a certain correlation between reference signals is detected. The filter controller 102 shown in Figure may be adapted to perform this procedure, e.g., a processor that implements the filter controller 102 includes software that allows for assessing a value corresponding to a degree of correlation and comparing this value with a threshold.

In some applications, e.g. in multi-channel, adaptive systems, such as a multi-channel acoustic echo canceller (MCAEC), it may have some merits to decorrelate the reference signals so that these become statistically independent and hence allow for a distinct, i.e. unambiguous estimation of the "real" room impulse responses (RIRs). This is, for example, applicable in an automatic equalization system designed to compensate for different room characteristics in order to ideally achieve a subjectively similar tonal balance, independent of the room where the device is used and/or the position of the device in the room.

The drawback described above does not exist if a mono signal is used as a reference. If a stereo signal is used as a reference, there are usually also no negative effects since a typical stereo input signal offers a sufficiently high degree of decorrelation between its left- and right channel. However, if an up-mixing algorithm is used to create several signals based on its (mainly) stereo input, we do face the problem of ambiguity, if no further actions are taken to decorrelate its output signals, which may be used as reference signals for the MCAEC. In such cases, it may be beneficial to introduce additional decorrelation to one or more output signals of the up-mixer before they are used as references for the MCAEC.

The systems and methods described above provide a simple and efficient way to implement a decorrelator that, in addition, does not create significant supererogatory acoustical artifacts. An allpass filter (AP) chain is used including, for example, parametric filters in order to enable a simple time-variation of certain parameters, such as its filter qualities and/or of its cut-off frequencies. Further, a fix set of cut-off frequencies, distributed over a certain, restricted frequency range, may be used in combination with time varying quality factors, where the latter are also restricted to a defined, adjustable range, to avoid acoustical artifacts, which may occur if, e.g. too high quality factor values are employed.

The method described above may be encoded in a computer-readable medium such as a CD ROM, disk, flash memory, RAM or ROM, an electromagnetic signal, or other machine-readable medium as instructions for execution by a processor. Alternatively or additionally, any type of logic may be utilized and may be implemented as analog or digital logic using hardware, such as one or more integrated circuits (including amplifiers, adders, delays, and filters), or one or more processors executing amplification, adding, delaying, and filtering instructions; or in software in an application programming interface (API) or in a Dynamic Link Library (DLL), functions available in a shared memory or defined as local or remote procedure calls; or as a combination of hardware and software.

The method may be implemented by software and/or firmware stored on or in a computer-readable medium, machine-readable medium, propagated-signal medium, and/or signal-bearing medium. The media may comprise any device that contains, stores, communicates, propagates, or transports executable instructions for use by or in connection with an instruction executable system, apparatus, or device. The machine-readable medium may selectively be, but is not limited to, an electronic, magnetic, optical, electromagnetic, or infrared signal or a semiconductor system, apparatus, device, or propagation medium. A non-exhaustive list of examples of a machine-readable medium includes: a magnetic or optical disk, a volatile memory such as a Random Access Memory "RAM," a Read-Only Memory "ROM," an Erasable Programmable Read-Only Memory (i.e., EPROM) or Flash memory, or an optical fiber. A machine-readable medium may also include a tangible medium upon which executable instructions are printed, as the logic may be electronically stored as an image or in another format (e.g., through an optical scan), then compiled, and/or interpreted or otherwise processed. The processed medium may then be stored in a computer and/or machine memory.

The systems may include additional or different logic and may be implemented in many different ways including a controller that implements the filter chain and/or the filter controller. A controller may be implemented as a microprocessor, microcontroller, application specific integrated circuit (ASIC), discrete logic, or a combination of other types of circuits or logic. Similarly, memories may be DRAM, SRAM, Flash, or other types of memory. Parameters (e.g., conditions and thresholds) and other data structures may be separately stored and managed, may be incorporated into a single memory or database, or may be logically and physically organized in many different ways. Programs and instruction sets may be parts of a single program, separate programs, or distributed across several memories and processors.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. A decorrelator for decorrelating an input signal comprising:

a controllable allpass filter arrangement configured to phase shift the input signal by a phase shift, the controllable allpass filter arrangement comprising one or more controllable allpass filter stages connected in series, and each controllable allpass filter stage having a filter quality factor and a cut-off frequency; and a filter controller operatively connected to the controllable allpass filter arrangement and configured to control at least one of the filter quality factor and the cut-off frequency of the one or more controllable allpass filter stages to change over time, wherein the input signal that is phase-shifted by the controllable allpass filter corresponds with at least one output of an up-mixer;

wherein the phase-shifted input signal includes at least one reference signal fora multi-channel acoustic echo canceller;

wherein the filter quality factor is restricted to be within a given range;

wherein the given range of the filter quality factor is adjustable; and wherein the input signal that is phase shifted by the controllable allpass filter includes the at least one reference signal for the multi-channel acoustic echo canceller.

2. The decorrelator of claim 1, wherein the cut-off frequency is fixed and the filter quality factor is time varying.

3. The decorrelator of claim 2, wherein the cut-off frequency is within a restricted frequency range.

4. The decorrelator of claim 3, wherein the cut-off frequency is selected based on a psychoacoustic scale.

5. The decorrelator of claim 1, wherein the one or more controllable allpass filter stages have a parametric filter structure.

6. The decorrelator of claim 1, wherein the one or more controllable allpass filter stages have a Lattice ladder filter structure.

7. The decorrelator of claim 1, wherein the filter controller comprises a random generator configured to generate random control signals to control at least one of the filter quality factor and the cut-off frequency of the one or more controllable allpass filter stages.

8. The decorrelator of claim 1, wherein the filter controller is configured to detect a correlation between the input signal and at least one comparison signal, and to control at least one of the filter quality factor and the cut-off frequency of the one or more controllable allpass filter stages dependent on the correlation.

9. The decorrelator of claim 1, wherein at least one of the filter quality factor and the cut-off frequency is interpolated over time.

10. A decorrelation method for decorrelating an input signal comprising:

allpass filtering the input signal to phase shift the input signal by a phase shift, the allpass filtering comprising filtering with one or more controllable allpass filter stages, each controllable allpass filter stage having a filter quality factor and a cut-off frequency; and controlling at least one of the filter quality factor and the cut-off frequency of the one or more controllable allpass filter stages to change over time, wherein the input signal that has been phase shifted by the allpass filtering corresponds with at least one output of an up-mixer;

wherein the phase-shifted input signal includes at least one reference signal fora multi-channel acoustic echo canceller;

wherein the filter quality factor is restricted to be within a given range;

wherein the given range of the filter quality factor is adjustable; and wherein the input signal that has been phase shifted by the allpass filtering includes the at least one reference signal for the multi-channel acoustic echo canceller.

11. The decorrelation method of claim 10, wherein the cut-off frequency is selected from a restricted frequency range.

12. The decorrelation method of claim 10, wherein the one or more controllable allpass filter stages have a parametric filter structure.

13. The decorrelation method of claim 10, wherein the one or more controllable allpass filter stages have a Lattice ladder filter structure.

14. The decorrelation method of claim 10, wherein controlling the one or more controllable allpass filter stages comprises generating random control signals for controlling at least one of the filter quality factor and the cut-off frequency of the one or more controllable allpass filter stages.

15. The decorrelation method of claim 10, wherein controlling the one or more controllable allpass filter stages comprises detecting a correlation between the input signal and at least one comparison signal, and controlling at least one of the filter quality factor and the cut-off frequency of the one or more controllable allpass filter stages dependent on the correlation.

16. The decorrelation method of claim 10, wherein at least one of the filter quality factor and the cut-off frequency is interpolated over time.

17. A computer program product comprising instructions which, when the instructions are executed by a computer, cause the computer to:

phase shift an input signal by a phase shift by filtering the input signal with one or more allpass filter stages, each allpass filter stage having a filter quality factor and a cut-off frequency; and controlling at least one of the filter quality factor and the cut-off frequency of the one or more allpass filter stages to change over time, wherein the input signal that has been phase shifted by being filtered with one or more allpass filter stages corresponds with at least one output of an up-mixer;

wherein the phase-shifted input signal includes at least one reference signal fora multi-channel acoustic echo canceller;

wherein the filter quality factor is restricted to be within a given range;

wherein the given range of the filter quality factor is adjustable; and wherein the input signal that has been phase shifted by being filtered with one or more allpass filter stages includes the at least one reference signal for the multi-channel acoustic echo canceller.

* * * * *